US005613246A

United States Patent [19]

Alexander

[11] Patent Number: 5,613,246

[45] Date of Patent: Mar. 25, 1997

[54] CAP WITH A REMOVABLE AND REVERSIBLE VISOR

[76] Inventor: Billy Alexander, 6639 Rock Lake Dr., Charlotte, N.C. 28214

[21] Appl. No.: 493,788

[22] Filed: Jun. 22, 1995

[51] Int. Cl.[6] ..... A42B 1/06

[52] U.S. Cl. ..... 2/10; 2/195.1; 2/181; 2/DIG. 2

[58] Field of Search ..... 2/10, 195.1, DIG. 2, 2/12, 175.1, 175.2, 181, 181.2, 181.4, 209.12, 209.13

[56] References Cited

U.S. PATENT DOCUMENTS

| | | | |
|---|---|---|---|
| 4,023,212 | 5/1977 | Huffman | 2/197 |
| 4,630,317 | 12/1986 | Brown et al. | 2/12 |
| 4,873,726 | 10/1989 | Tapia | 2/195 |
| 4,989,270 | 2/1991 | Boughten | 2/171.7 |
| 5,070,545 | 12/1991 | Tapia | 2/195 |
| 5,091,995 | 3/1992 | Oates | 2/195 |
| 5,181,277 | 1/1993 | Sherman | 2/181.4 |
| 5,477,629 | 12/1995 | Gleason, Jr. | 2/DIG. 2 |
| 5,488,740 | 2/1996 | Garza | 2/175.1 |

*Primary Examiner*—Diana Biefeld
*Attorney, Agent, or Firm*—W. Thad Adams, III, P.A.

[57] ABSTRACT

A cap includes a crown with an annular base shaped to fit the head of a wearer, and a reversible visor having first and second opposing major surfaces. The visor includes an outwardly extending arcuate flange located along an inside edge of the first and second major surfaces. First and second cooperating attachment members are located respectively on the flange and on the crown proximate the base for removable attachment of the visor to the crown. The flange is movable between a first visor attachment position on the crown wherein the first major surface of the visor faces upwardly during wear, and a second visor attachment position on the crown wherein the second major surface of the visor faces upwardly during wear.

10 Claims, 6 Drawing Sheets

CAP WITH A REMOVABLE AND REVERSIBLE VISOR

TECHNICAL FIELD AND BACKGROUND OF THE INVENTION

This invention relates to a cap with a visor which is both removable and reversible. The invention can be worn to display a particular insignia, such as an advertisement, logo, design, color, or emblem of a sports team, company, or organization, and then quickly and easily modified by the wearer to display an alternate insignia. For example, when attending a basketball game, a person may arrange the cap to display the colors or logo of his favorite basketball team. When attending another event, such as a football game, the wearer can simply rearrange the same cap to display an alternate color or logo representing his favorite football team.

According to one prior art cap disclosed in U.S. Pat. No. 5,070,545 issued to Tapia, the cap includes a crown and a removable visor. Insignia patches of various styles are removably attached to the crown and visor such that a single cap can be readily modified to identify two or more sports teams or organizations.

In the Tapia cap of the '545 patent, the removable patches detract from the conventional appearance of the cap, and are subject to being inadvertently removed, lost, or stolen. Moreover, the visor of the Tapia cap is not reversible, and does not provide two major display surfaces for displaying insignia, such as advertisements, logos, designs, colors, or emblems.

The present invention overcomes these and other limitations of prior art caps by providing a cap which includes a removable and reversible visor having two opposing, major surfaces. The invention is readily modified to display either one of the major surfaces during wear, thus allowing the wearer to identify with two different sports teams, companies, or organizations by simply removing and reversing the visor. Moreover, the invention maintains the general appearance of a conventional cap, and does not utilize removable patches which can be inadvertently removed, lost, or stolen.

SUMMARY OF THE INVENTION

Therefore, it is an object of the invention to provide a cap which includes a removable and reversible visor.

It is another object of the invention to provide a cap which is readily modified by the wearer to display either of two major surfaces of the visor during wear.

It is another object of the invention to provide a cap which resembles the appearance of a conventional cap.

It is another object of the invention to provide a cap including a crown which can be detached from the visor and separately laundered.

It is another object of the invention to provide a cap which is comfortable to wear.

These and other objects of the present invention are achieved in the preferred embodiments disclosed below by providing a cap. The cap includes a crown with an annular base shaped to fit the head of a wearer, and a reversible visor having first and second opposing major surfaces. The visor includes an outwardly extending arcuate flange located along an inside edge of the first and second major surfaces. First and second cooperating attachment members are located respectively on the flange and on the crown proximate the base for removable attachment of the visor to the crown. The flange is movable between a first visor attachment position on the crown wherein the first surface of the visor faces upwardly during wear, and a second visor attachment position on the crown wherein the second surface of the visor faces upwardly during wear.

According to one preferred embodiment of the invention, the first and second attachment members comprise a zipper assembly. The zipper assembly includes first and second rows of teeth located respectively on the flange and on the crown proximate the base. A movable slide is operatively connected to the first row of teeth for mating the first and second rows of teeth together.

According to another preferred embodiment of the invention, the slide includes first and second teeth receiving openings formed at opposite ends thereof. Each of the openings serves to receive a leading end of the second row of teeth to mate the first and second rows of teeth together. Thus, the flange of the visor is removably attachable to the crown in either of the first or second visor attachment positions.

According to yet another preferred embodiment of the invention, the said first and second attachment members include complementary hook and loop fasteners.

According to yet another preferred embodiment of the invention, the first and second attachment members include complementary snap fasteners.

According to yet another preferred embodiment of the invention, an adjustment means is located at the base of the crown for adjusting the circumference of the base to fit the head of the wearer.

According to yet another preferred embodiment of the invention, a stiffening means is carried by the visor for stiffening the visor upon attachment to the base of the crown.

According to yet another preferred embodiment of the invention, the first and second major surfaces of the visor include respective display insignia.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
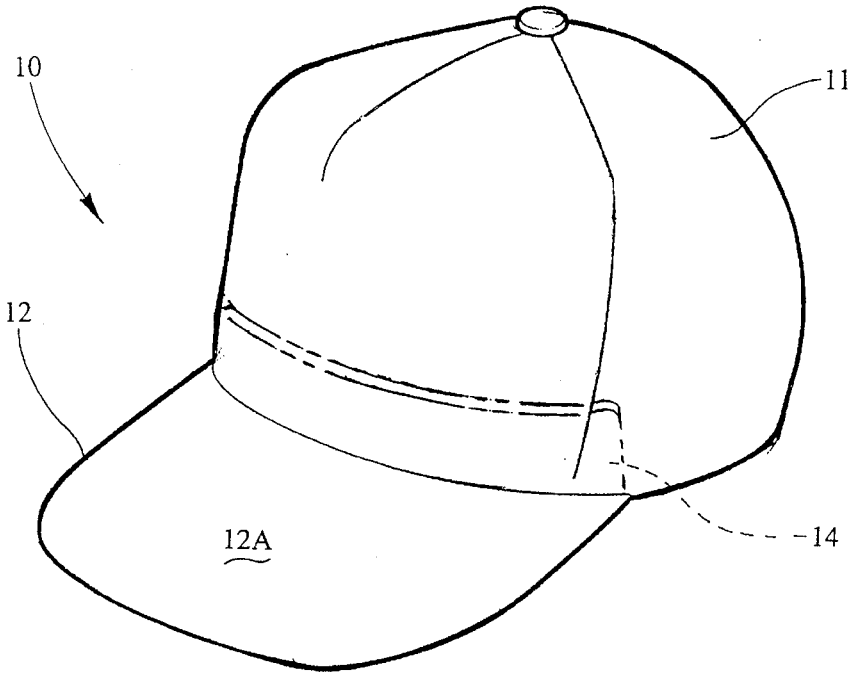
FIG. 1 is a perspective view of a cap according to one preferred embodiment of the invention, and showing the visor attached to the crown of the cap such that a first major surface of the visor faces upwardly during wear.
Figure 2:
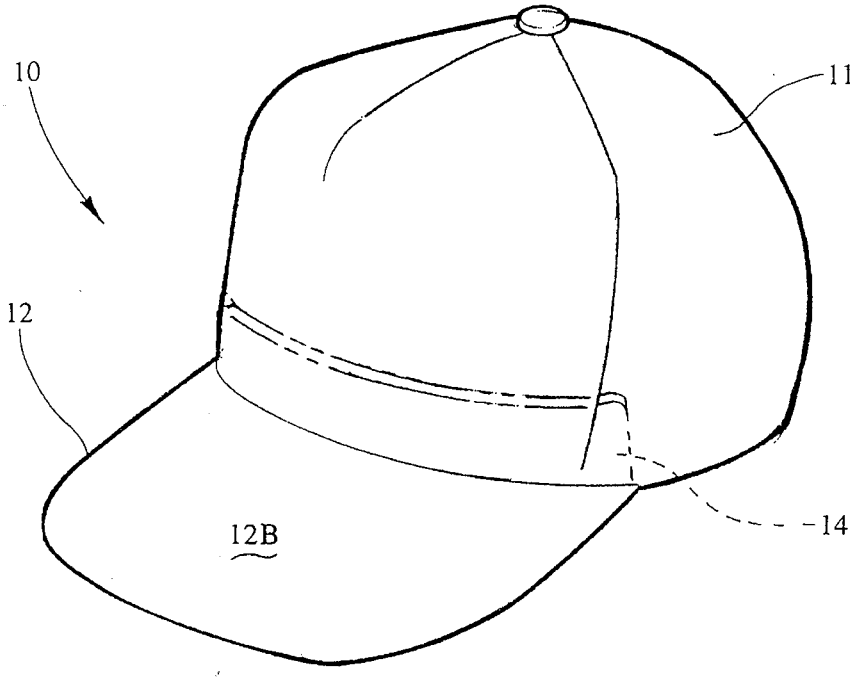
FIG. 2 is a perspective view of the cap showing the visor attached to the crown of the cap such that an opposing, second major surface of the visor faces upwardly during wear.

Referring now specifically to the drawings, a cap according to the present invention is illustrated in FIG. 1 and shown generally at reference numeral 10. The cap 10 preferably resembles a conventional baseball-type cap, and includes a crown 11 and a visor 12. The visor 12 has two opposing major surfaces 12A and 12B (See FIGS. 1 and 2), and is easily removable and reversible by the wearer such that a desired one of the two major surfaces 12A and 12B faces upwardly during wear. Preferably, each of the major surfaces 12A and 12B includes a different insignia, such as a sport team's logo or colors (not shown). Caps 10 and 10' are shown, respectively, in FIGS. 1 and 2 to illustrate the alternate attachment of the visor 12.

A first embodiment of the cap 10 is illustrated in FIGS. 3–7 with the visor 12 oriented as in FIG. 1. As shown, the visor 12 includes an upwardly extending arcuate flange 14 formed along an inside perimeter of its first and second major surfaces 12A and 12B. A zipper assembly 15 cooperates to removably attach the visor 12 to the crown 11. The zipper assembly 15 includes a pull slide 16, and first and second rows of complementary teeth 17 and 18 located respectively on the flange 14 and on the crown 11. The second row of teeth 18 is carried by a tape strip 19 sewn to an inside wall of the crown 11. The first row of teeth 17 is carried by a top edge of the flange 14.

Figure 3:
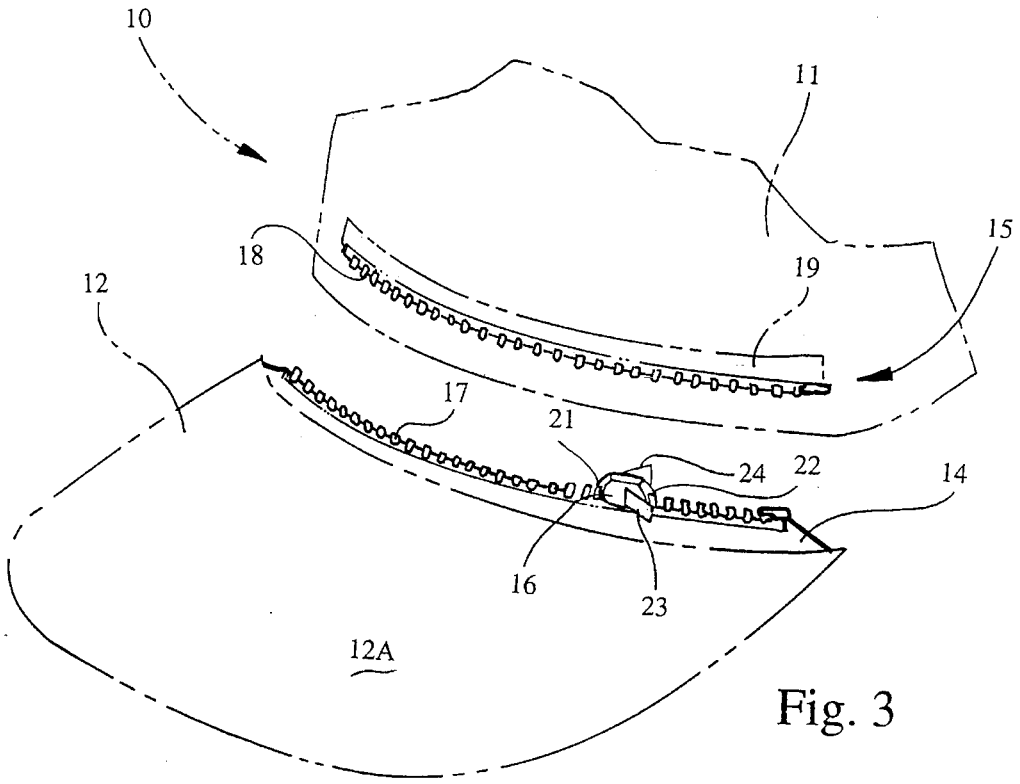
FIG. 3 is a fragmentary perspective view of the cap in phantom, and showing the zipper assembly for removably attaching the visor to the crown.
Figure 4:
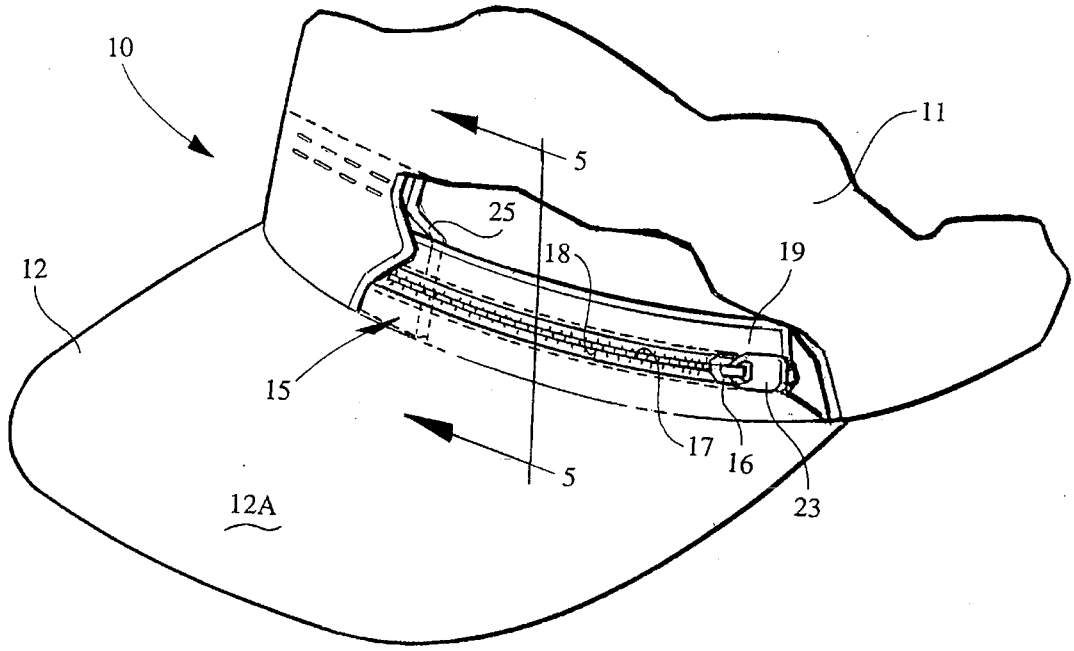
FIG. 4 is a fragmentary perspective view of the cap with surfaces broken away to better illustrate the zipper assembly.
Figure 5:
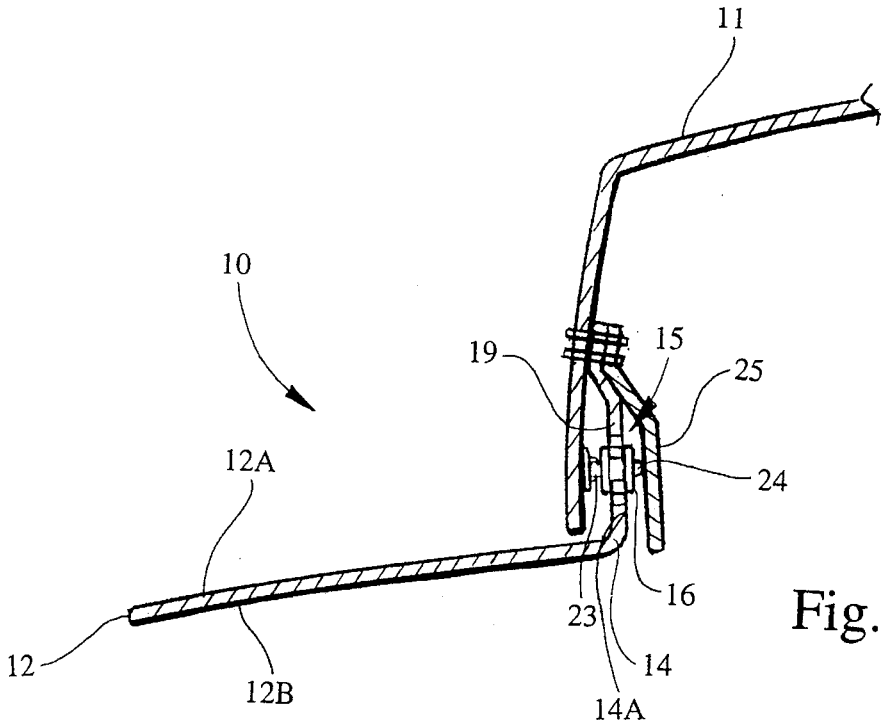
FIG. 5 is a fragmentary cross-sectional view of the cap illustrated in FIG. 4, and taken substantially along lines 5—5.
Figure 6:
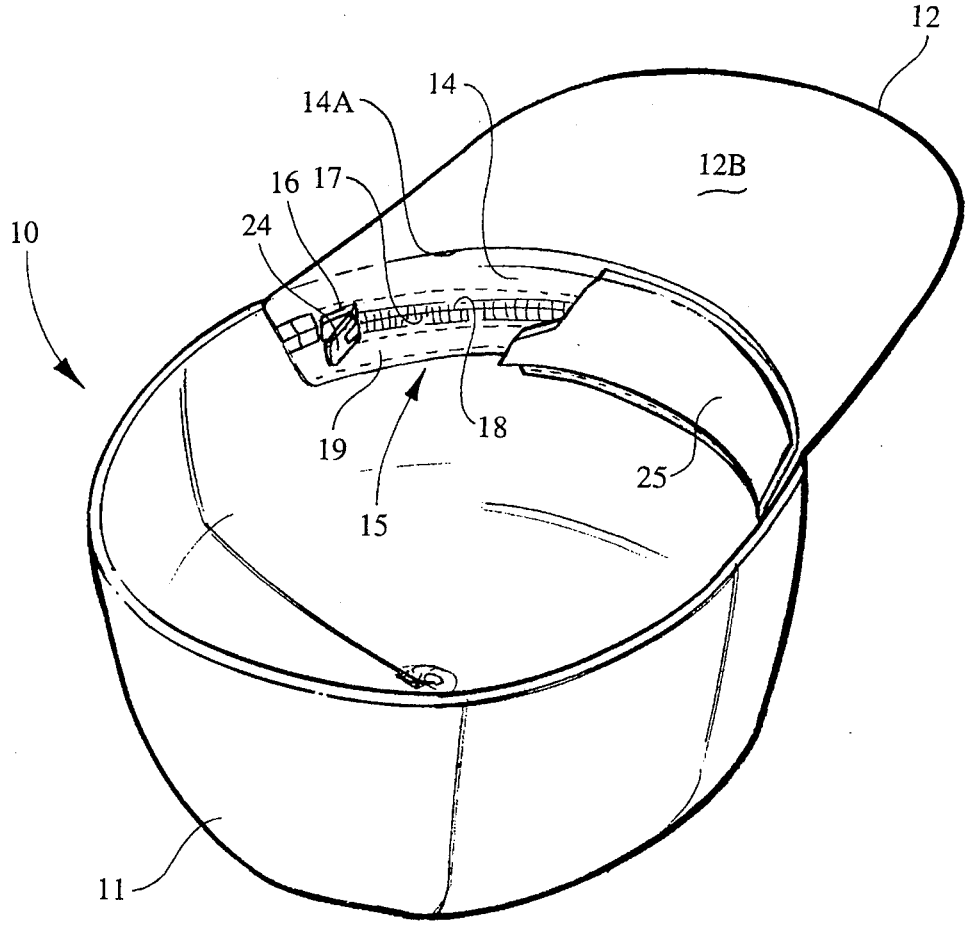
FIG. 6 is a perspective underside view of the cap in an inverted condition, and showing a portion of the comfort liner broken away.

As best shown in FIG. 3, the slide 16 is preferably a common two-way zipper slide which runs along the length of the first row of teeth 17. The slide 16 includes openings 21 and 22 formed at each end for receiving the second row of teeth 18 from either end thereof to mate the first and second rows of teeth 17 and 18 together. Elongate pull tabs 23 and 24 are located on opposite sides of the slide 16 for being manually pulled by the wearer to open and close the zipper assembly 15.

As shown in FIGS. 4–7, a comfort liner 25 is located adjacent to the tape strip 19 to provide a soft, comfortable barrier between the zipper assembly 15 and the forehead of the wearer during wear. The comfort liner 25 is sewn along its top edge to the inside wall of the crown 11. The bottom edge of comfort liner 25 is unattached to permit easy access by the wearer to the zipper assembly 15. Preferably, the comfort liner 25 is formed of terry-knit cotton, or blend of cotton and other hydrophilic or hydrophobic fabric materials.

Figure 7:
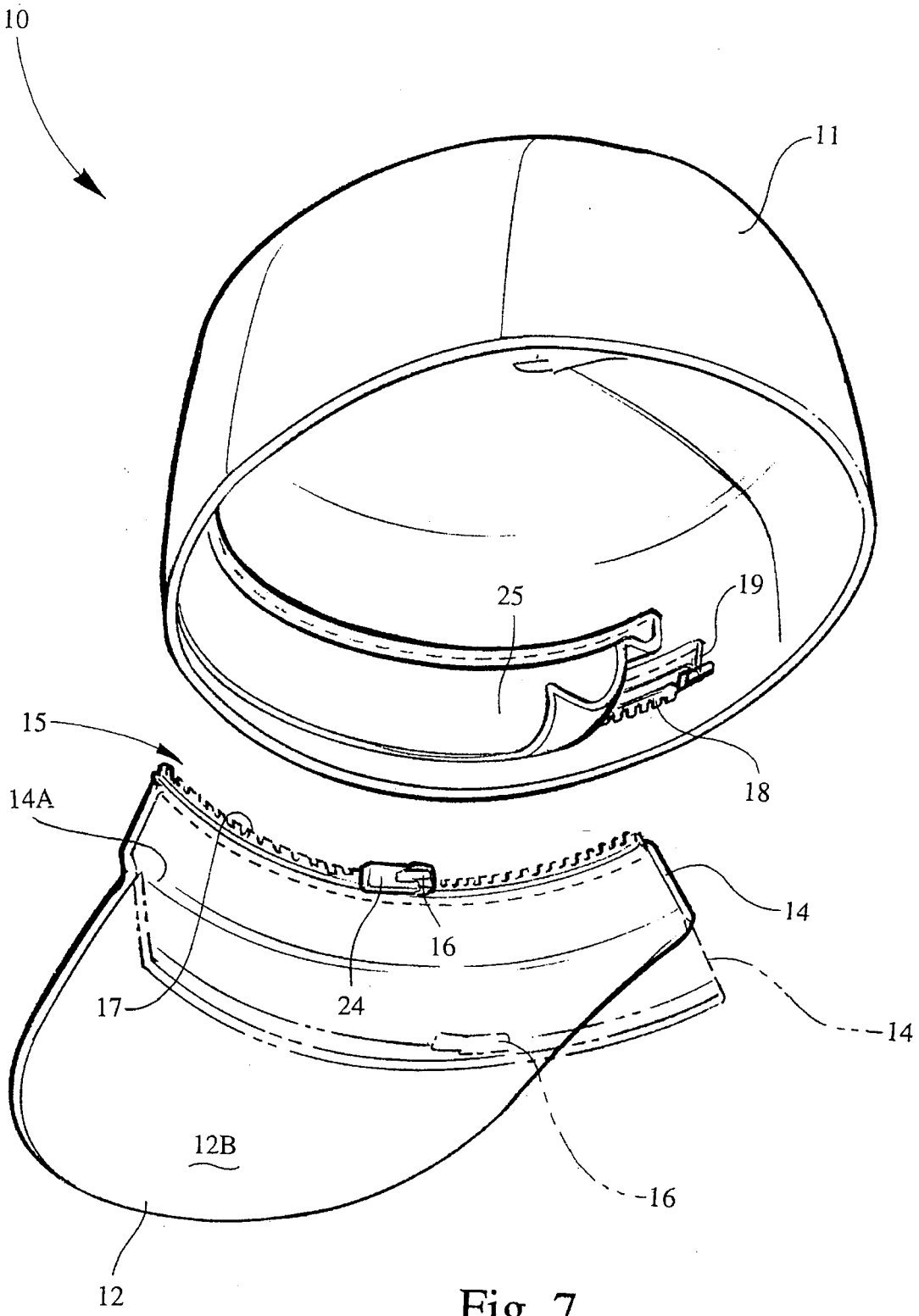
FIG. 7 is a perspective underside view of the cap with the visor separated from the crown.

Referring to FIG. 7, the flange 14 of the visor 12 is hinge-connected at 14A, and is movable by the wearer between first and second visor attachment positions on the crown 11. In the first attachment position, the first major surface 12A of the visor 12 faces upwardly during wear (See FIG. 1). In the second attachment position shown in phantom, the second major surface 12B of the visor 12 faces upwardly during wear (See FIG. 2).

Preferably, a flexible hinge (not shown) is located at the bend of the flange 14, and serves to further support and stiffen the visor 12 when attached to the crown 11. The hinge may be formed of a durable plastic material, and extends along the entire length of the flange 14.

To reverse the visor 12 and display its alternate major surface 12B, the wearer first removes the cap 10 and separates the visor 12 from the crown 11 by pulling the slide 16 of the zipper assembly 15 to open the zipper assembly 15. The flange 14 is then pivoted downwardly to its second visor attachment position, as shown in FIG. 7. The visor 12 is inverted, and the slide 16 reattached to the second row of teeth 18 to close the zipper assembly 15 as described above.

Figure 8:
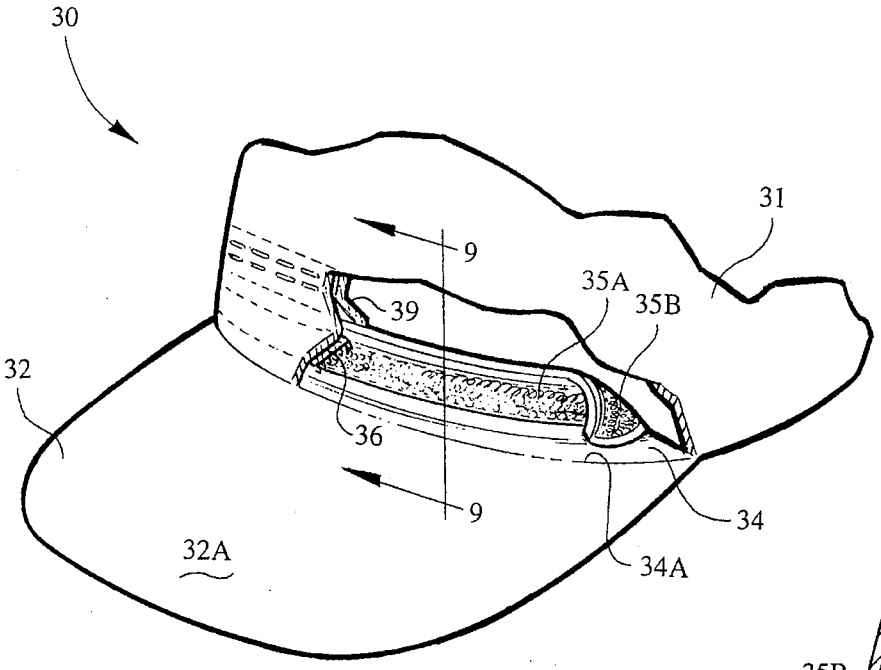
FIG. 8 is a fragmentary perspective view of a second embodiment of the cap with surfaces broken away to better illustrate the hook and loop fasteners for removably attaching the visor to the crown.
Figure 9:
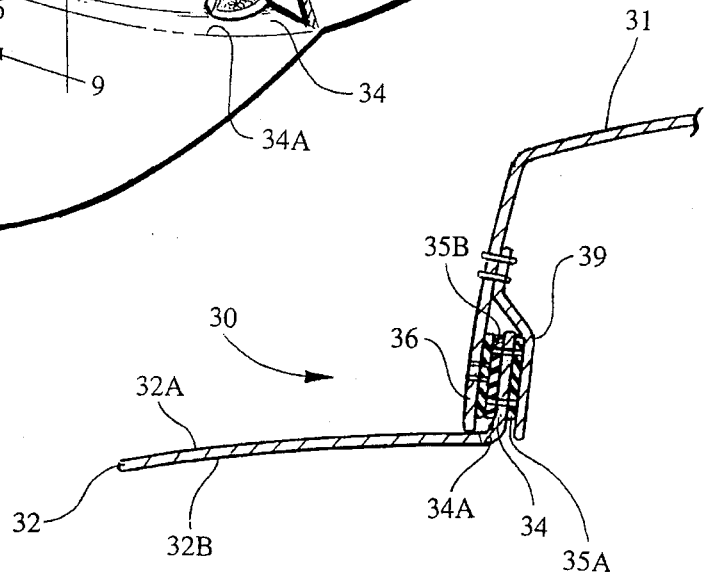
FIG. 9 is a fragmentary cross-sectional view of the cap illustrated in FIG. 8, and taken substantially along lines 9—9.
Figure 10:
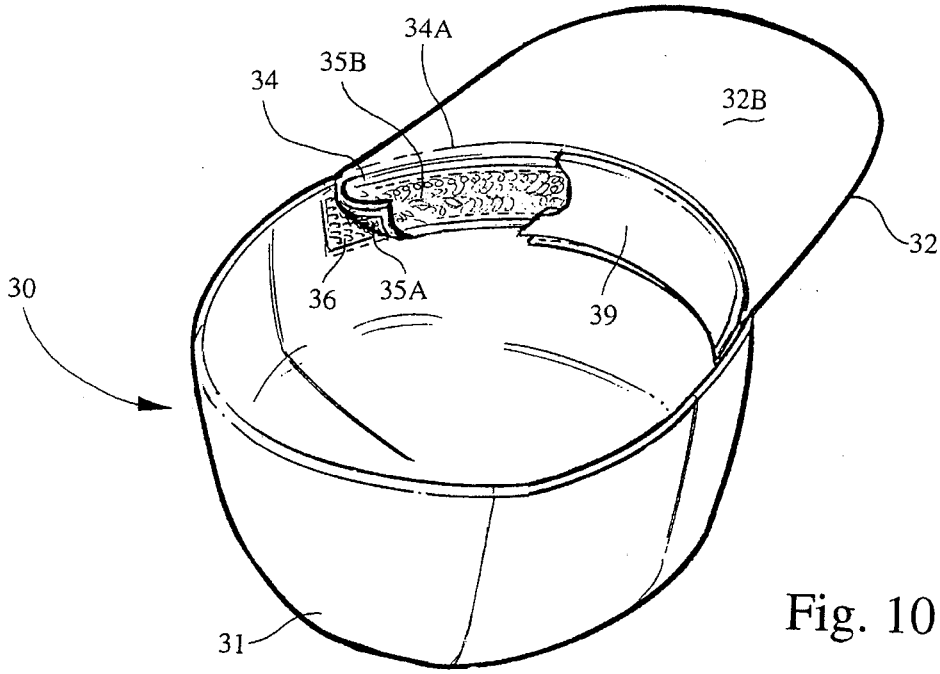
FIG. 10 is a perspective underside view of the cap in an inverted condition, and showing a portion of the comfort liner broken away.

A second embodiment of a cap 30 is illustrated in FIGS. 8–10. Cap 30 includes a crown 31 and a reversible visor 32 removably attached to the crown 31 for displaying one of two major surfaces 32A and 32B of the visor 32 in an upwardly facing position. The visor 32 includes an arcuate flange 34 formed along an inside perimeter of its first and second major surfaces 32A and 32B. Loop fastener strips 35A and 35B are preferably located on opposite sides of the arcuate flange 34 for being mated with a complementary strip 36 of hook fasteners located along an inside base of the crown 31.

The flange 34 of the visor 32 is hinge-connected at 34A, and is movable by the wearer between first and second visor attachment positions on the crown 31, as described above. The opposing loop fastener strips 35A and 35B and hook fastener strip 36 cooperate to permit attachment in each of these two positions. In the first visor attachment position, the loop fastener strip 35A of one side of the flange 34 mate with the hook fastener strip 36 of the crown 31 such that the first major surface 32A of the visor 32 faces upwardly during wear. In the second visor attachment position, the loop fastener strip 35B of the opposite side of the flange 34 mate with the hook fastener strip 36 of the crown 31 such that the second major surface 32B of the visor 32 faces upwardly during wear.

Preferably, a flexible hinge (not shown) is located at the bend of the flange 34, and serves to further support and stiffen the visor 32 when attached to the crown 31. The hinge may be formed of a durable plastic material, and extends along the entire length of the flange 34.

In addition, a comfort liner 39 is located adjacent to the flange 34 to provide a soft, comfortable barrier between the hook and loop fastener strips 35A, 35B and 36 and forehead of the wearer during wear. The comfort liner 39 is sewn along its top edge to the inside wall of the crown 31. The bottom edge of comfort liner 39 is unattached. Preferably, the comfort liner 39 is formed of terry-knit cotton, or blend of cotton and other hydrophilic or hydrophobic fabric materials.

Figure 11:
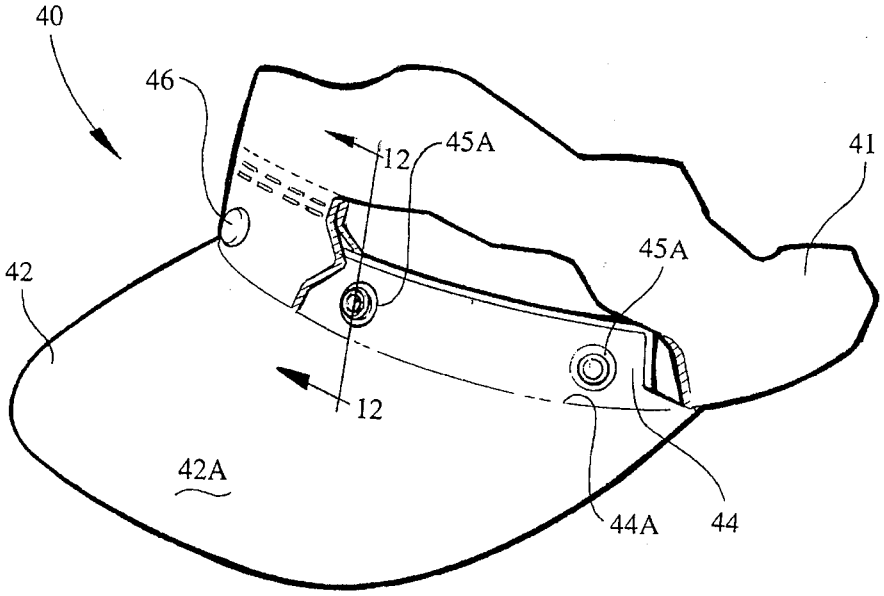
FIG. 11 is a fragmentary perspective view of a third embodiment of the cap with surfaces broken away to better illustrate the male and female snaps for removably attaching the visor to the crown.
Figure 12:
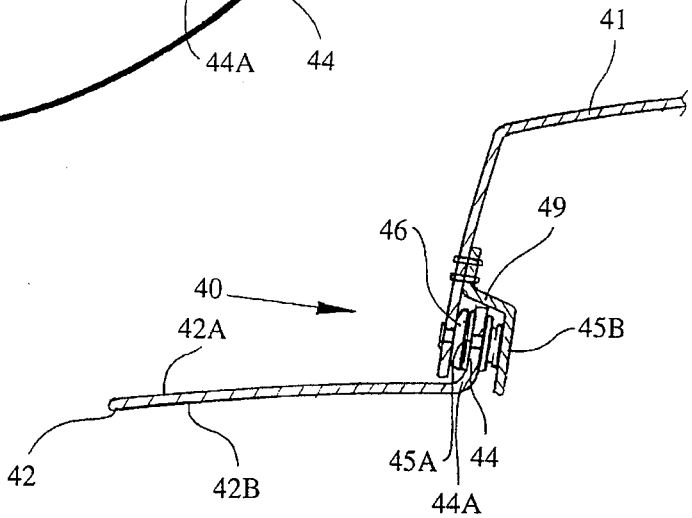
FIG. 12 is a fragmentary cross-sectional view of the cap illustrated in FIG. 11, and taken substantially along lines 12—12.
Figure 13:
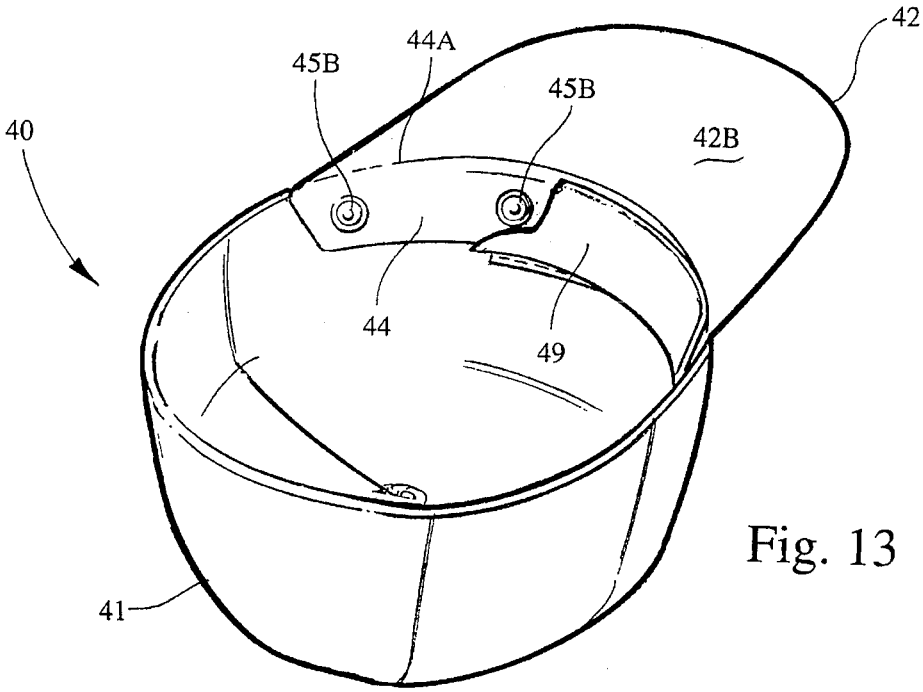
FIG. 13 is a perspective underside view of the cap in an inverted condition, and showing a portion of the comfort liner broken away.

A third embodiment of a cap 40 is illustrated in FIGS. 11–13. Cap 40 includes a crown 41, and a reversible visor 42 removably attached to the crown 41 for displaying one of two major surfaces 42A and 42B in an upwardly facing condition. The visor 42 includes an arcuate flange 44 formed along an inside perimeter of its first and second major surfaces 42A and 42B. A number of male snaps 45A and 45B are preferably located on opposite sides of the arcuate flange 44 for being mated, respectively, with complementary female snaps 46 located along an inside base of the crown 41.

The flange 44 of the visor 42 is hinge-connected at 44A, and is movable by the wearer between first and second visor attachment positions on the crown 41, as described above. The male and female snaps 45A, 45B and 46 cooperate to permit attachment in each of these two positions. In the first visor attachment position, the male snaps 45A located on one side of the flange 44 mate with the female snaps 46 of the crown 41 such that the first major surface 42A of the visor 42 faces upwardly during wear. In the second visor attachment position, the male snaps 45B located on the opposite side of the flange 44 mate with the female snaps 46 of the crown 41 such that the second major surface 42B faces upwardly during wear.

Preferably, a flexible hinge (not shown) is located at the bend of the flange 44, and serves to further support and stiffen the visor 42 when attached to the crown 41. The hinge may be formed of a durable plastic material, and extends along the entire length of the flange 44.

In addition, a comfort liner 49 is located adjacent to the flange 44 to provide a soft, comfortable barrier between the male and female snaps 45A, 45B and 46 and the forehead of the wearer during wear. The comfort liner 49 is sewn along its top edge to the inside wall of the crown 41. The bottom edge of comfort liner 49 is unattached. Preferably, the comfort liner 49 is formed of terry-knit cotton, or blend of cotton and other hydrophilic or hydrophobic fabric materials.

A cap with a removable and reversible visor is described above. Various details of the invention may be changed without departing from its scope. Furthermore, the foregoing description of the preferred embodiment of the invention is provided for the purpose of illustration only and not for the purpose of limitation—the invention being defined by the claims.

I claim:

1. A cap, comprising:

(a) a crown including an annular base shaped to fit the head of a wearer;

(b) a reversible visor having first and second opposing major surfaces, and including an outwardly extending arcuate flange hinge-connected along an inside edge of the first and second major surfaces of the visor;

(c) first and second cooperating attachment members located respectively on the flange and on the crown proximate the base for removable attachment of the visor to the crown; and (d) the flange being movable at said hinge connection between a first visor attachment position on the crown wherein the first major surface of the visor faces upwardly during wear, and a second visor attachment position on the crown wherein the second major surface of the visor faces upwardly during wear; and (e) a liner formed on an inside surface of the crown proximate the base for residing adjacent to the flange of said visor, and providing a comfort barrier between the first and second attachment members and the forehead of the wearer.

2. A cap according to claim 1, wherein said first and second attachment members comprise a zipper assembly including first and second rows of teeth located respectively on the flange and on the crown proximate the base, and a movable slide operatively connected to the first row of teeth for mating the first and second rows of teeth together.

3. A cap according to claim 2, wherein the slide includes first and second teeth receiving openings formed at opposite ends thereof for receiving, respectively, a leading end of the second row of teeth to mate the first and second rows of teeth together.

4. A cap according to claim 1, wherein said first and second attachment members comprise complementary hook and loop fastener strips.

5. A cap according to claim 1, wherein said first and second attachment members comprise complementary snap fasteners.

6. A cap according to claim 1, and including stiffening means carried by said visor for stiffening said visor upon attachment to the base of said crown.

7. A cap according to claim 1, wherein the first and second major surfaces of the visor include respective display insignia.

8. A cap, comprising:

(a) a crown including an annular base shaped to fit the head of a wearer;

(b) a reversible visor having first and second opposing major surfaces, and including an outwardly extending arcuate flange hinge-connected along an inside edge of the first and second major surfaces;

(c) a zipper assembly including first and second rows of teeth located respectively on the flange and on the crown proximate the base, and a movable slide operatively connected to the first row of teeth for mating the first and second rows of teeth together;

(d) the flange being movable at said hinge connection between a first visor attachment position on the crown wherein the first major surface of the visor faces upwardly during wear, and a second visor attachment position on the crown wherein the second major surface of the visor faces upwardly during wear;

(e) a liner formed on an inside surface of the crown proximate the base for residing adjacent to the flange of said visor, and providing a comfort barrier between the first and second attachment members and the forehead of the wearer; and (f) stiffening means carried by said visor for stiffening said visor upon attachment to the base of said crown.

9. A cap according to claim 8, wherein the slide includes first and second teeth receiving openings formed at opposite ends thereof, each of said openings for receiving a leading end of the second row of teeth to mate the first and second rows of teeth together, whereby the flange of the visor is removably attachable to the crown in either of the first or second visor attachment positions.

10. A cap according to claim 8, wherein the first and second major surfaces of the visor include respective display insignia.

* * * * *